US010926988B2

(12) United States Patent
Cremasco

(10) Patent No.: US 10,926,988 B2
(45) Date of Patent: Feb. 23, 2021

(54) FUNNEL WITH TOOL HOLDER

(71) Applicant: 2146844 Ontario Limited, Guelph (CA)

(72) Inventor: Paolo Cremasco, Guelph (CA)

(73) Assignee: 2146844 Ontario Limited, Guelph (CA)

( * ) Notice: Subject to any disclaimer, the term of this patent is extended or adjusted under 35 U.S.C. 154(b) by 37 days.

(21) Appl. No.: 15/773,276

(22) PCT Filed: Oct. 18, 2016

(86) PCT No.: PCT/CA2016/051207
§ 371 (c)(1),
(2) Date: May 3, 2018

(87) PCT Pub. No.: WO2017/075697
PCT Pub. Date: May 11, 2017

(65) Prior Publication Data

US 2018/0327242 A1 Nov. 15, 2018

(30) Foreign Application Priority Data

Nov. 3, 2015 (CA) ..... CA 2911028
Apr. 8, 2016 (CA) ..... CA 2926672

(51) Int. Cl.
*B67C 11/02* (2006.01)

(52) U.S. Cl.
CPC ..... *B67C 11/02* (2013.01); *B67C 2011/022* (2013.01); *B67C 2011/025* (2013.01)

(58) Field of Classification Search
None
See application file for complete search history.

(56) References Cited

U.S. PATENT DOCUMENTS 1,668,245 A * 5/1928 McGowen ..... F01M 11/0408 184/1.5
2,746,330 A * 5/1956 Pfetzing ..... B25B 27/0042 81/124.7

(Continued)

FOREIGN PATENT DOCUMENTS

| | | | |
|---|---|---|---|
| CA | 2911028 | A1 | 5/2017 |
| FR | 2834709 | A1 | 7/2003 |
| WO | 2017/075697 | A1 | 5/2017 |

OTHER PUBLICATIONS

International Preliminary Report on Patentability dated May 8, 2018 in respect of International Application No. PCT/CA2016/051207.

*Primary Examiner* — Daphne M Barry
(74) *Attorney, Agent, or Firm* — Bereskin & Parr LLP/S.E.N.C.R.L, s.r.l.

(57) ABSTRACT

A funnel can include an inlet orifice, an outlet orifice and a sidewall extending axially between the inlet orifice and the outlet orifice. The funnel can also include a tool holder for holding at least one tool and that is disposed within the funnel. At least first and second support members can extend between an inner surface of the sidewall and the tool holder to support the tool holder within the funnel. The first support member, second support member and tool holder may be rotatable with the sidewall about a funnel axis to rotatably drive a tool connected to the tool holder when the funnel is rotated about the funnel axis by a user.

20 Claims, 10 Drawing Sheets

(56) References Cited

U.S. PATENT DOCUMENTS

| | | | | | |
|---|---|---|---|---|---|
| 3,911,983 | A | * | 10/1975 | Wyatt | B25B 13/48 81/438 |
| 4,714,138 | A | * | 12/1987 | Zaccone | B25B 27/0042 137/320 |
| 4,800,933 | A | | 1/1989 | Moore et al. | |
| 4,951,721 | A | * | 8/1990 | Moore | B25B 27/0042 141/331 |
| 5,259,426 | A | * | 11/1993 | Burleigh | B25B 27/0042 141/331 |
| 5,852,961 | A | * | 12/1998 | Kotowski | B25B 27/0042 81/180.1 |
| 5,921,292 | A | * | 7/1999 | Fouts | G07F 17/3244 141/331 |
| 5,960,907 | A | * | 10/1999 | Chau | B67C 11/00 141/114 |
| 5,979,516 | A | * | 11/1999 | Grant | F01M 11/0408 141/114 |

* cited by examiner

FUNNEL WITH TOOL HOLDER

CROSS-REFERENCE TO RELATED APPLICATIONS

This is a national stage application of International Application No. PCT/CA2016/051207 filed Oct. 18, 2016, which claims priority to Canadian Patent Application No. 2,911,028 filed Nov. 3, 2015 and on Canadian Patent Application No. 2,926,672 filed Apr. 8, 2016, and the entire contents of each are hereby incorporated herein by reference.

FIELD

The present subject matter of the teachings described herein relates generally to funnels.

BACKGROUND

A conventional funnel is designed to guide the flow of a substance into a narrow opening after the substance has been release from its container. Releasing the substance from its container can include a manual process of removing a plug from the container, or alternatively piercing the container sidewall. Such actions are performed using a suitable tool and then a conventional funnel is position adjacent an opening in the container to capture the substance draining from the container.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

In accordance with one broad aspect of the teachings described herein, a funnel an include an inlet orifice and an outlet orifice axially spaced apart from the inlet orifice along a central funnel axis about which the funnel can be rotated by a user. A sidewall may extend axially between the inlet orifice and the outlet orifice and can generally tapering toward the outlet orifice to guide a liquid entering the inlet orifice toward the outlet orifice. A tool holder for holding at least one tool can be disposed within the funnel and can be positioned axially between the inlet orifice and the outlet orifice. The tool holder may have an upper surface that is axially spaced apart from and faces the inlet orifice, and an opposing lower surface that is axially spaced apart from, faces and at least partially overlies the outlet orifice in a lateral direction that is transverse to the funnel axis. At least a first support member and a second support member that is spaced apart from the first support member may extend between an inner surface of the sidewall and the tool holder to support the tool holder within the funnel. The first support member, second support member and tool holder may be rotatable with the sidewall about the funnel axis to rotatably drive a tool connected to the tool holder when the funnel is rotated about the funnel axis by a user.

The sidewall, tool holder and support member may be of integral, one-piece construction.

The inlet orifice may have an inlet flow area that is transverse to the funnel axis and the tool holder may have a holder area that is transverse to the funnel axis and is between about 3% and about 25% of the inlet flow area.

The first and second flange may be positioned on substantially laterally opposite sides of the funnel.

The tool holder may include a releasable socket mount for interchangeably supporting a plurality of differently sized sockets.

The tool holder may include a substantially planar tool support platform upon which the socket mount is supported.

In accordance with another broad aspect of the teachings described herein, which may be used alone or in combination with any other aspects, a funnel may include an inlet orifice and an outlet orifice that is axially spaced apart from the inlet orifice along a central funnel axis about which the funnel can be rotated by a user. At least one sidewall may extend between the inlet orifice and the outlet orifice and may generally taper toward the outlet orifice to guide a liquid entering the inlet orifice toward the outlet orifice. A tool holder for holding at least one tool may be positioned to at least partially overlap the inlet orifice in a lateral direction that is transverse to the funnel axis. At least a first support member may extend between the tool holder and the sidewall to support the tool holder. The support member and tool holder may be rotatable with the sidewall about the funnel axis to rotatably drive a tool connected to the tool holder when the funnel is rotated by a user.

The first support member may extend between the tool holder and an inner surface of the sidewall to support the tool holder within the funnel so that the tool holder is spaced apart from the inner surface of the sidewall.

The tool holder may entirely overlap the inlet orifice in the lateral direction.

The tool holder may overlie the outlet orifice.

The tool holder may include an upper surface that faces and is axially spaced apart from the inlet orifice, and an opposing lower surface that faces and is axially spaced apart from the outlet orifice.

At least one grip member may be provided on an outer surface of the sidewall whereby a user can grip the funnel to impart rotation of the funnel about the central funnel axis.

The at least one grip member may include a first flange extending outwardly from the outer surface of the sidewall, and a second flange extending outwardly from the outer surface of the sidewall and being spaced apart from the first flange around a perimeter of the sidewall. The first and second flanges may be graspable by the fingers of a user.

Each flange may extend laterally outwardly from the outer surface by a respective flange height that is in a range of about 5 mm to about 150 mm.

Each flange may have a length in the axial direction that is in a range of between about 25 mm and about 200 mm.

The inlet orifice and the outlet orifice may be separated from each other by a funnel length along the funnel axis. Each flange may have a length in the axial direction that is in a range of between about 15% and about 70% of the funnel length.

A second support member may extend between the tool holder and the sidewall and may be spaced from the first support member. The first support member may extend along a first support axis that intersects the first flange, and the second support member may extend along a second support axis that intersects the second flange.

The tool holder may be disposed axially between the inlet orifice and the outlet orifice.

The tool holder may include a releasable socket mount for interchangeably supporting a plurality of differently sized sockets The tool holder may include a substantially planar tool support platform upon which the socket mount is supported.

The inlet orifice may be axially between the tool holder and the outlet orifice and may be intersected by the funnel axis.

The tool holder may include a ratchet mechanism, whereby at tool connected to the ratchet mechanism can rotate in one direction relative to the sidewall.

The first support member may include an upper surface that faces and is axially spaced apart from the inlet orifice and an opposing lower surface that faces an overlies at least a portion of the inner surface of the sidewall, whereby fluid can flow between lower surface of the first support member and the inner surface of the sidewall.

The lower surface of the first support member may overlie at least a portion of the outlet orifice.

The first support member may have an upper end comprising an upper surface that faces and is axially spaced apart from the inlet orifice and an opposing lower end that is at least partially connected to the inner surface of the sidewall.

The sidewall may include a first portion that is oriented at a first angle relative to the central funnel axis, and a frusto-conical second portion that is inclined at a second angle relative to the central funnel axis that is larger than the first angle. The second portion may be disposed axially between the first portion and the outlet orifice.

The first angle may be between about 0 degrees and about 30 degrees.

The first and second flanges may be disposed on the second portion of the sidewall.

The tool holder may be laterally surrounded by the first portion of the sidewall.

The first support member may extend from the first portion of the sidewall.

The tool holder may be disposed axially closer to the inlet orifice than to the outlet orifice.

A tool may be integrally formed with the tool holder.

In accordance with another broad aspect of the teachings described herein, which may be used alone or in combination with any other aspects, a method of opening a drain opening in a boundary wall of a container retaining a fluid using a funnel having a tool holder disposed within the funnel and supporting a tool can include the steps of:

a) positioning an inlet orifice of the funnel adjacent the boundary wall so that the drain opening is located within the funnel;
b) moving the funnel relative to the container to impart a corresponding movement of the tool supported by the tool holder whereby the tool engages the container and opens the drain opening allowing fluid to flow out through the drain opening;
c) catching the fluid flowing out through the opening in the funnel and conveying the fluid to an outlet orifice while the funnel is being rotated about the funnel axis.

Step b) may include removing a plug that is sealing the drain opening.

Step a) may include positioning at least a portion of the plug within the inlet orifice of the funnel and engaging the plug with the tool.

Step b) may include rotating the funnel about a central funnel axis, thereby causing corresponding rotation of the tool holder and tool about the funnel axis thereby causing corresponding rotation of the plug relative to the boundary wall to unthread the plug.

The tool may include a piercing member and step b) may include piercing a hole in the boundary wall to form the drain opening by moving the funnel toward the boundary wall.

The steps a)-c) may be performed without a user's hands being positioned axially between the inlet orifice and the boundary wall.

DRAWINGS

The drawings included herewith are for illustrating various examples of articles, methods, and apparatuses of the teaching of the present specification and are not intended to limit the scope of what is taught in any way.

DETAILED DESCRIPTION

Figure 1:
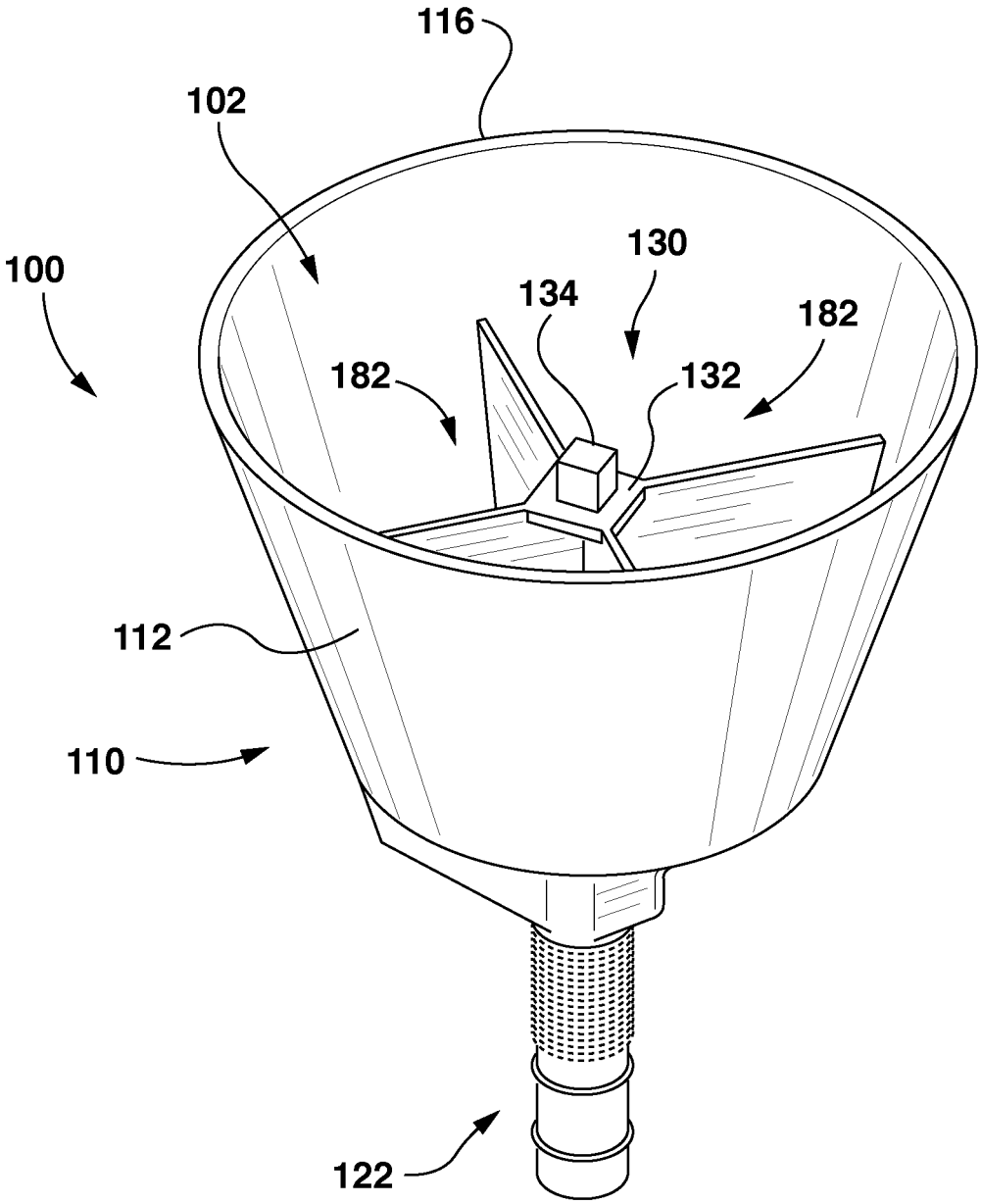
FIG. 1 is a perspective view of one example of a funnel.

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Funnels can be designed to guide the flow of a substance, often a liquid, from a relatively wide inlet opening to a relatively narrow outlet opening. Funnels may be used, for example, when the fluid has been released from a container or other source, and is intended to be directed into a second container or storage location.

In some instances, a container that contains a liquid can include a plug or other similar, removable object that is lodged in a drain opening one of the walls of the container. Removing the plug can allow the liquid to exit the container via the drain opening. A plug may be a threaded object, such as a bolt, or may be a non-threaded object, such as a cork or rubber stopper, an openable cap or lid, or the like.

Alternatively, instead of removing a plug from the container, a drain opening can be formed in a container sidewall, such as by piercing the sidewall with a tool, thereby allowing the liquid to flow from the container—through the drain opening.

In other examples, the container may include an openable drain member, such as a valve or spigot that can be opened to allow the liquid to drain from the container and closed to retain the liquid in the container.

In some instances, it is desirable to catch or otherwise divert the liquid exiting the container. In such situations, a funnel can be positioned below the drain opening so that when fluid flows out if the drain opening it falls into the funnel (for example by the force of gravity), where it can then be guided to a suitable disposal or storage location. Optionally, the outlet of the funnel can be connected to a hose or other suitable conduit to help convey the fluid to a relatively remote container.

Sometimes, opening the drain opening on the container can require the use of tools, such as a wrench, socket, piercing member (such as a spike), screw driver, drills and the like. For example, a container such as the oil pan on a car may have a drain opening that is sealed by a threaded plug. To drain the oil from the oil pan, a user first unscrews the plug. When the plug is initially loosened, oil may tend to start leaking from the oil pan even before the plug is completely removed. While a funnel may be positioned generally beneath the drain opening, oil that leaks during the loosening (or tightening) process may tend to flow onto the tools being used (such as a wrench or socket driver) as well as onto the hands of the user.

Also, in some situations the proximity of the funnel relative to the drain opening may be limited by the need to allow space for a tool, and a portion of the user's hands, to be positioned between the funnel and the container in order to access and remove the plug. Such gaps between the funnel and the container may increase the chances that at least some of the fluid will miss the funnel, and perhaps foul a surrounding surface.

Optionally, a funnel can be configured to incorporate and/or support a tool within the interior of the funnel. In this arrangement, a user can manipulate the outer portions of the funnel in order to manipulate the tool that is used to form the drain opening (such as by removing a plug, piercing a hole in the chamber wall, etc.). When the funnel tool is used to open the drain, such as by unthreading a plug, any fluid that leaks out will be caught and contained within the funnel, instead of coating a separate tool or the user's hands. Preferably, the outer portions of the funnel (such as its sidewalls, grip members, etc.) can be drivingly connected to the tool within the funnel so that moving or rotating the funnel can lead to a corresponding movement or rotation of the tool to engage the plug, without a user needing to position his/her hands within the interior of the funnel or axially between the funnel and the container.

Figure 2:
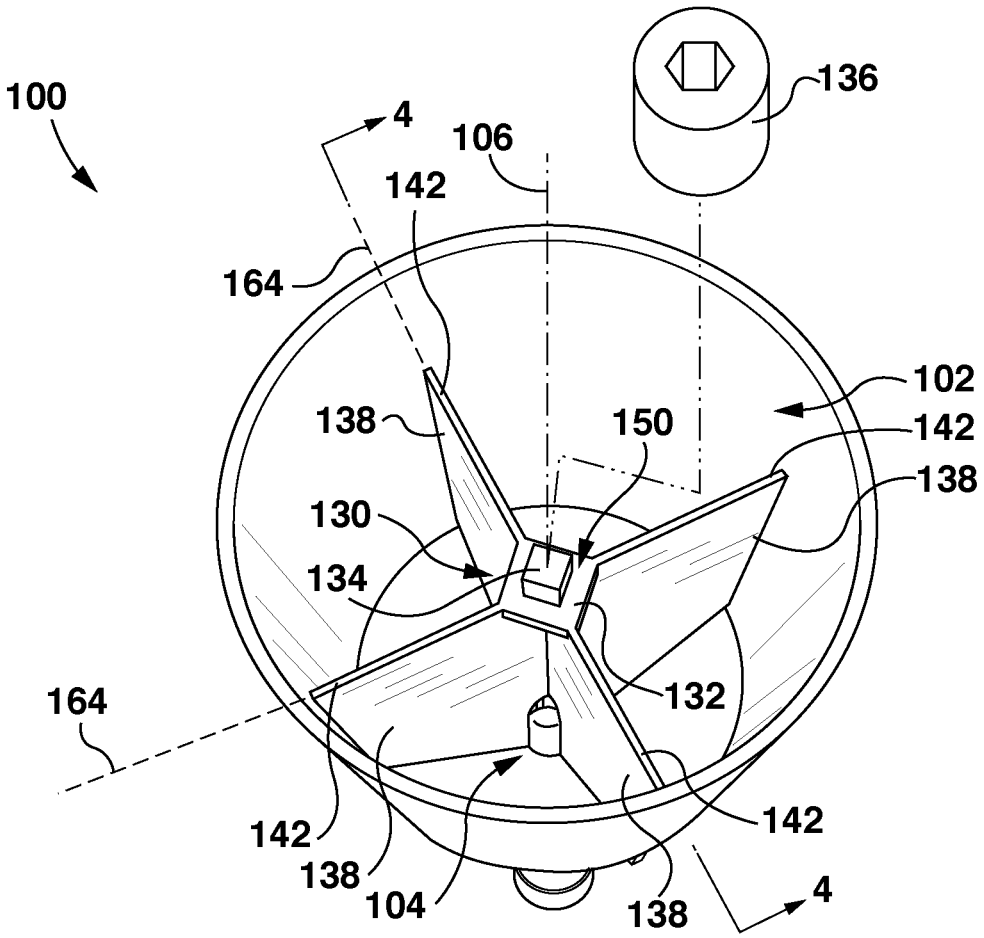
FIG. 2 is top perspective view of the funnel of FIG. 1.

Referring to FIGS. 1 and 2, one example of funnel 100 includes an inlet orifice 102 at its upper end, and an outlet orifice 104 axially spaced apart from the inlet orifice along a central funnel axis 106. The outlet orifice 104 is positioned at a lower end of the funnel 100 and can, optionally, be fluidly connected to hose (such as hose 108 in FIG. 3) or other such conduit.

Figure 3:
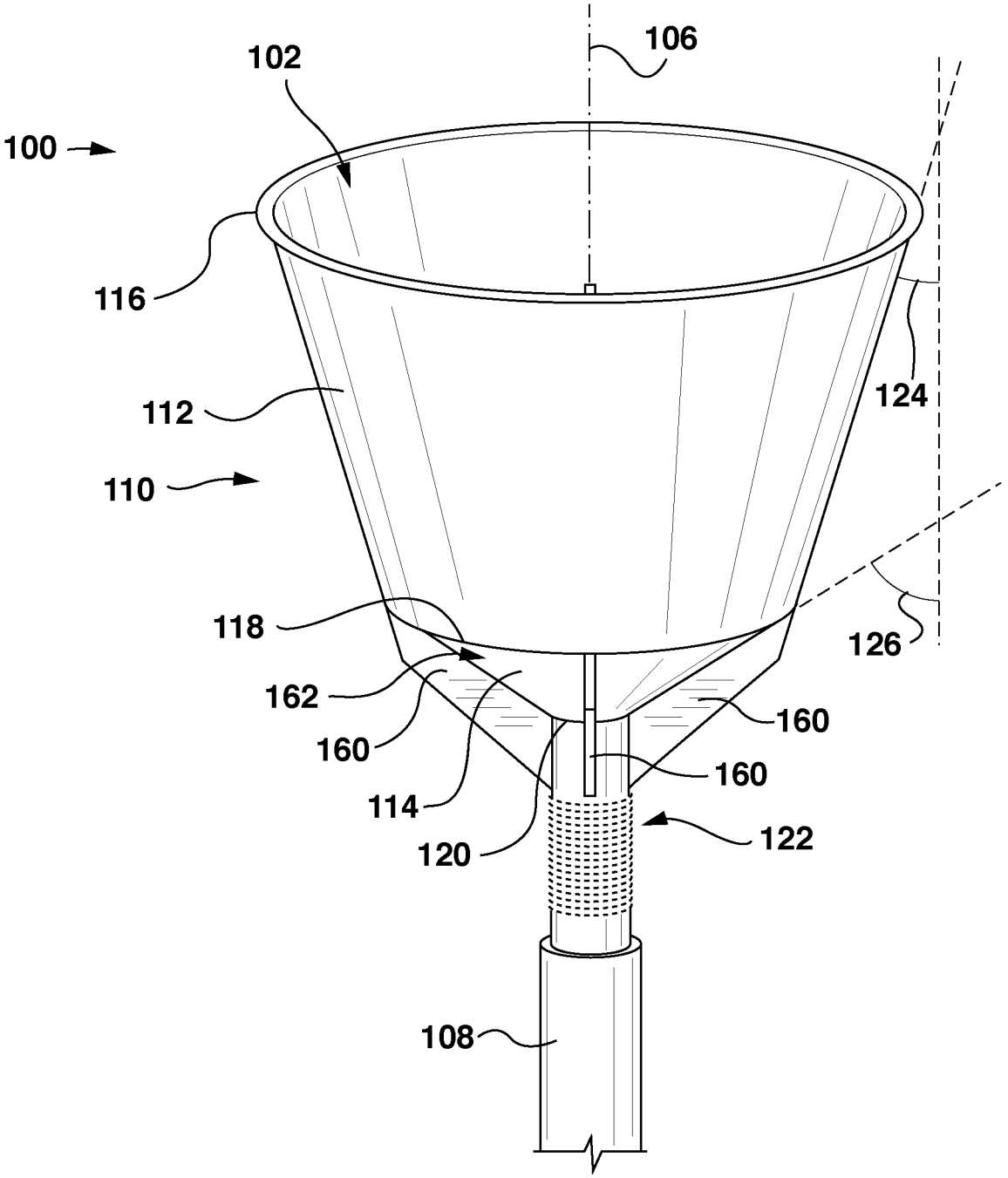
FIG. 3 is a side perspective view of the funnel of FIG. 1.

A sidewall 110 extends axially between the inlet orifice 102 and the outlet orifice 104 to guide any liquid that enters the funnel 100 via the inlet orifice 102 toward the outlet orifice 104. The sidewall 110 can have any suitable configuration, and in the illustrated example is generally tapering toward the outlet orifice 104. Referring also to FIG. 3, in the illustrated example, the sidewall 110 includes two portions having different slopes/inclinations. A first or upper portion 112 of the illustrated sidewall is less tapered than a second, lower portion 114 of the sidewall 110. In this example, the upper portion 112 of the sidewall extends from a rim 116 surrounding the inlet orifice 102 to a lower end 118, and the lower portion 114 of the sidewall extends from the lower end 118 of the upper portion to the rim 120 of the outlet orifice. A neck portion 122 of the sidewall extends beyond the outlet orifice 104, and can be configured to connect to the hose 108.

Both portions 112 and 114 may be considered generally frusto-conical in this example, but in other examples one or both of the portions may have substantially vertical walls (i.e. walls parallel to the funnel axis), curved walls or any other suitable configuration. Optionally, the sidewall 110 may include more than two portions having different properties/configurations, or may include only a single, generally tapering sidewall portion.

Referring to FIG. 3, in this example, the first portion 112 of the sidewall is oriented at a first angle 124 relative to the funnel axis 106, and the frusto-conical second portion 114 that is inclined at a second angle 126 relative to the axis 106 that is larger than the first angle 124. The sidewall 110, and its portions, may be inclined at any suitable angle relative to the funnel axis 106, including angles that are between about 0 degrees (i.e. parallel) and about 85 degrees, and may be between about 5 degrees and about 60 degrees, between about 10 degrees and about 50 degrees and/or between about 25 degrees and 45 degrees. Optionally, for example, the first angle 124 may be between about 0 degrees and about 30 degrees. The second angle 126 may be the same as the first angle 124 or may be larger than the first angle 124 (as illustrated) or smaller than the first angle 124.

Optionally, to help hold a tool that can be used to open a drain opening on a container that is holding a liquid; the funnel 100 can include a tool holder 130. In the illustrated example, the tool holder 130 is disposed within the interior of the funnel 100, such that it is axially between the inlet and outlet orifices 102, 104, but may have other configurations in other examples.

The tool holder may have any suitable configuration and may be adapted to receive a variety of tools. Preferably, the tool holder may be configured to releasably receive a variety of different tools (such as different sockets, screw drive bits, allan keys, piercing members, spikes, saw blades, etc.) so that the funnel can be used to engage a variety of different objects.

Figure 5:
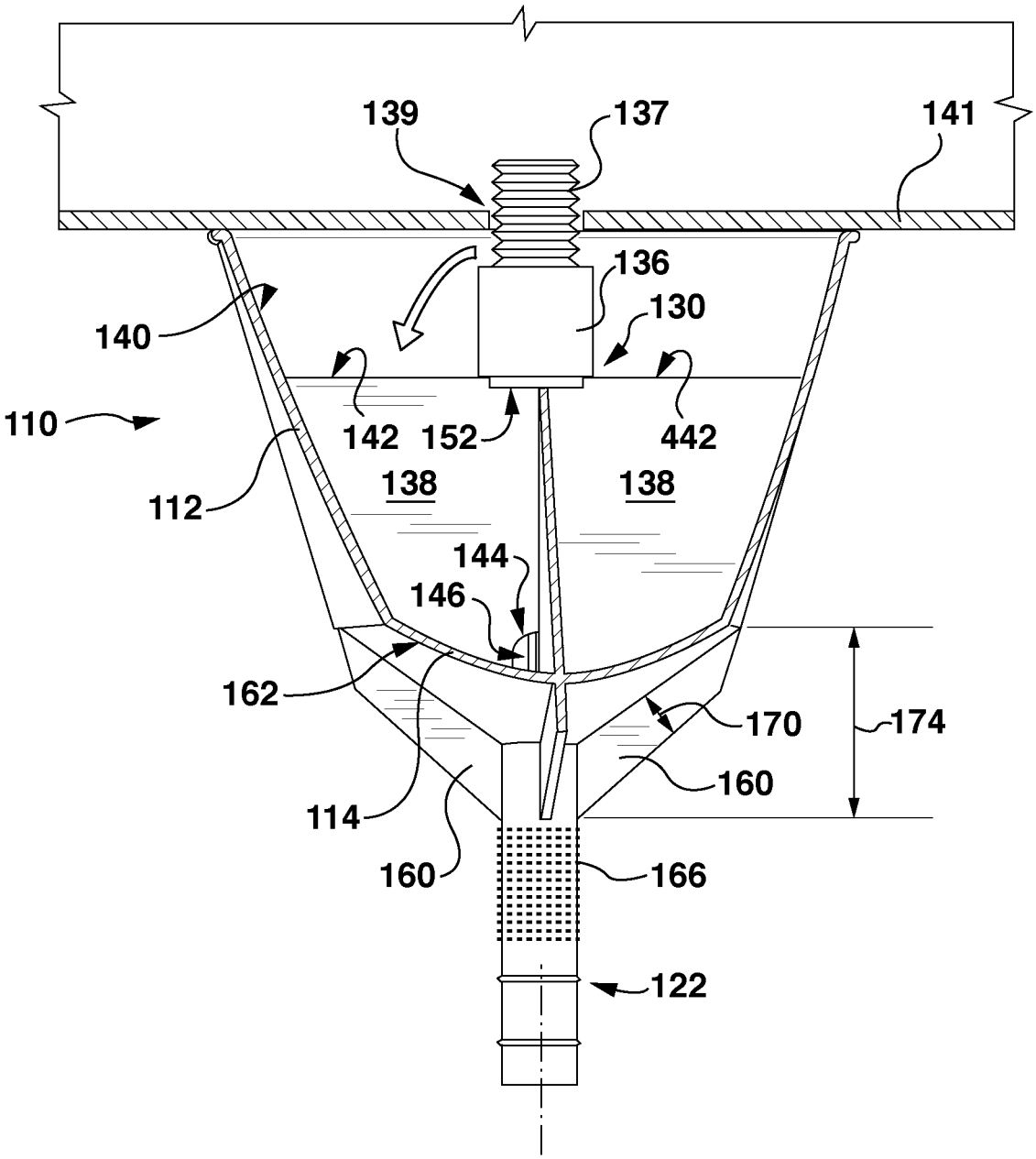
FIG. 5 is a partial-cut away view of the funnel of FIG. 1, with a portion of the funnel sidewall removed.

Referring to FIGS. 1 and 2, in the illustrated example, the tool holder 130 includes a generally planer tool support platform 132 and a releasable socket mount 134 that is positioned on the platform 132 for interchangeably supporting a plurality of differently sized sockets, such as exemplary socket 136. This may allow a common tool support platform to be used with a variety of socket attachments, and to engage a variety of different sized plugs, fasteners and the like. Referring also to FIG. 5, in the illustrated example the funnel 100 can be used to drive the socket 136 to unscrew a threaded plug 137 that is used to seal a drain opening 139 in the sidewall 141 of a container holding a liquid. As the plug 137 is loosened, liquid can leak through the train opening 139 and can be caught in the funnel 100.

Optionally, the tool holder 130 can be connected to the funnel using any suitable mechanism. For example, the tool holder 130 can be connected to the sidewall 110, or other portions, of the funnel 100 using one or more support members. The support members can help hold the tool holder 130 in a desired position relative to the sidewall 110. Optionally, the support members can hold the tool holder 130 in a fixed position relative to the sidewall 110. In such a configuration, movement of the sidewall 110 may lead to corresponding movement of the tool holder 130, and any tool, such as socket 136, mounted on the tool holder 130. For example, translating the sidewall 110 axially can lead to axial movement of the tool holder 130, and/or rotating the sidewall 110 about the funnel axis 106 can result in corresponding rotation of the tool holder 130. The funnel 100 may include more than one support member, and may include at least first and second support members that are spaced apart from each other. Preferably, the support members are configured so that they do not completely block the flow of liquid through the funnel.

Referring to FIG. 2, in the illustrated example the tool holder 130 is positioned axially between the inlet orifice 102 and the outlet orifice 104 and is held in position by four support members 138. Each support member 138 extends between the tool holder 130 and an inner surface 140 (FIG. 5) of the funnel sidewall 110. In the illustrated example, the support members 138 are connected to the inner surface 140 on both the upper portion 112 and lower portion 114 of the sidewall 110, but alternatively could be connected to only one of the upper or lower portion of the sidewall, or to any other suitable portion of the funnel.

Figure 4:
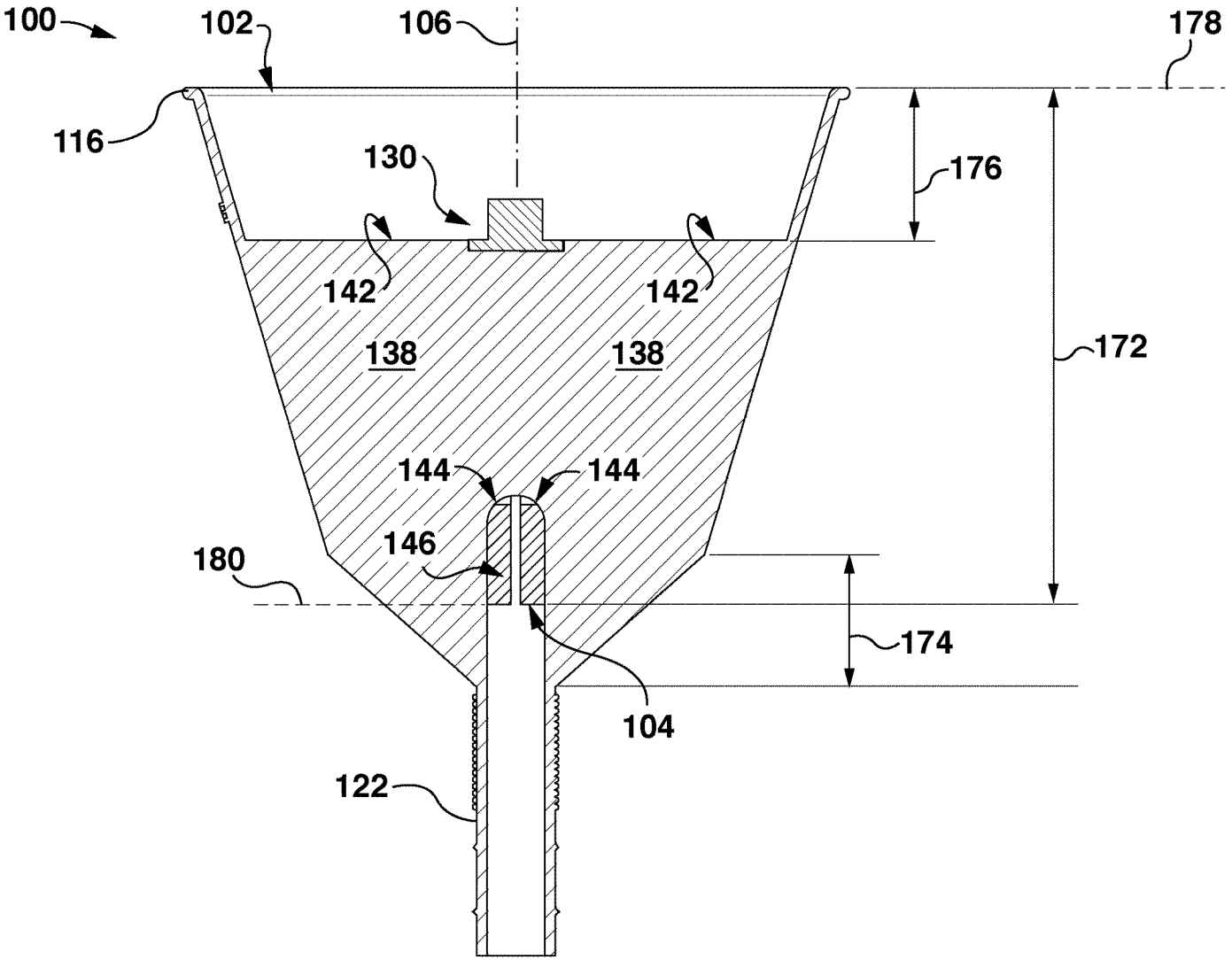
FIG. 4 is a cross-sectional view of the funnel of FIG. 1, taken along line 4-4.

In the illustrated example, each support member 138 has an upper surface 142 that is spaced below, and faces the inlet orifice. Referring also to FIGS. 4 and 5, each support member also has an opposing lower surface 144 that is spaced above and overlies a portion of the outlet orifice 104. In this arrangement, a gap 146 is provided so that liquid can flow beneath the support members 138 and the tool support holder 130 and exit the funnel 100.

In the illustrated example, the support members 138 are rotatable with the sidewall, so that the support members 138, and the tool holder 130, will rotate in unison with the sidewall 100 about the funnel axis 106.

Referring to FIG. 2, in this example, the tool holder 130 has an upper surface 150 that is axially spaced apart from and faces the inlet orifice 102, and an opposing lower surface 152 (FIG. 5) that is axially spaced apart from, faces a portion of the sidewall 110 and a portion of the outlet orifice 104. When the tool holder 130 is relatively laterally centered within the funnel (as illustrated), the funnel axis 106 may intersect the tool holder 130 and the lower surface 152 of the tool holder can at least partially overlie the outlet orifice 104. Optionally, the tool holder 130 may be positioned entirely above the outlet orifice 104, entirely above the sidewall 110 (i.e. does not overlie the outlet orifice 104) or may extend over both the sidewall 110 and the outlet orifice 104.

Optionally, the sidewall 110, tool holder 130 and support members 138 may be integrally formed together from any suitable material, such as plastic or metal, so that the funnel 100 is of integral, one-piece construction. Alternatively, the sidewall 110, tool holder 130 and support member(s) 138 may be formed from different pieces and may be joined together using any suitable mechanism (such as fasteners, adhesives, interference fit and the like).

Optionally, the funnel 100 may include one or more grip members to help a user grip the funnel. This may help the user to grasp and manipulate the funnel 100, and may help a user indirectly apply a desired amount of driving force on the tool holder 130 via the surrounding portions of the funnel 100. The configuration of the grip members can be selected based on a variety of criteria, including, for example the size of the funnel, the desired amount of force to be transferred to the tool holder, the surrounding physical environment in which the funnel will be used, and the like. For example, if a user wants to transfer relatively high amounts of force via the tool holder, the grip members may be relatively large to allow a user to grip them securely using his/her full hands, and optionally to attach an external lever or other such torque-increasing device. Alternatively members may be smaller so that they are configured to be grasped only by a user's finger tips, rather than his/her full hands. For example, a grip member on the funnel 100 may extend laterally outwardly from the funnel by a height that is in a range of about 5 mm to about 150 mm, and may be between about 10 mm and about 50 mm. A funnel may include a plurality of grip members.

Preferably, the one or more suitable grip members can be provided on an outer surface of the funnel. This may be a convenient location for the user, and may help reduce the chances that liquid in the funnel will spill onto the grips. This location may also help create a mechanical advantage (i.e. increase the moment arm) when a user applies rotational forces via the grips. This may help a user rotate threaded fasteners using a comfortable level of force.

Optionally, the grip members of the funnel can include one or more flanges that extend laterally outwardly from the outer surface of the funnel sidewall. If multiple flanges are used, they may be spaced apart from each other around the outer perimeter/circumference of the funnel. This may help provide a variety of spaced apart grip locations.

Referring to FIG. 3, in the illustrated example, the funnel includes grip members in the form of four flanges 160 that extend from an outer surface 162 of the sidewall 110, and also contact the neck portion 122 (see also FIG. 5). In this example, each flange 160 is generally aligned with one of the support members 138, such that the flange 160 and its corresponding support member 138 lie on a common radially oriented support axis 164 (FIG. 2). This may help transfer the forces applied to the flanges 160 to the corresponding support member 138. Alternatively, the location of the flanges may be independent of the location of the support members.

Optionally, the flanges can be formed from a material that has a relatively low thermal conductivity. In such a configuration, the flanges may provide some thermal insulation and may help insulate a user's hands and fingers from the body of the funnel, and from the liquid in the funnel. For example, if the liquid in the funnel is hot grasping the funnel by the handles may help reduce the amount of heat transferred to the user's hands (as compared to, for example, directly grabbing the funnel sidewall).

Referring to FIG. 5, the funnel 100 also includes a grip member in the form of a textured surface portion 166 provided on the neck portion 122 of the funnel. This optional textured surface portion 166 need not be provided in other examples. Alternatively, a funnel may include grip members in the form textured surfaces, and need not include flanges. For example, other portions of the outer surface 162 of the sidewall 110 can also be textured to help a user grip the funnel 100.

In this example, the flanges 160 are each sized to be grasped by the fingers of a user, and extend outwardly by a flange height 170 (FIG. 5) that is less than 50 mm.

Referring to FIGS. 4 and 5, in the illustrated example, the inlet orifice 102 and the outlet orifice 104 re separated from each other by a funnel length 172 along the funnel axis 106. The funnel length 172 an be any suitable distance, and in embodiments where the funnel is intended to be manually manipulated by a user, may be between about 2 cm and about 100 cm or more, and may be between about 5 cm and about 50 cm, and between about 10 cm and about 30 cm.

Optionally, the grip portion of the funnel may extend substantially the entire axial extent of the funnel. Alternatively, the grip portion may extend along only a portion of the axial length of the funnel. Optionally, the grip portion may have a length in the axial direction that is in a range of between about 25 mm and about 200 mm, and/or may be in a range of between about 15% and about 70% of the funnel length, and may be between about 20% and 40% of the funnel length.

In the illustrated example, the flanges 160 have a length 174 in the axial direction that is between about 20% and about 25% of the funnel length 172.

Figure 9:
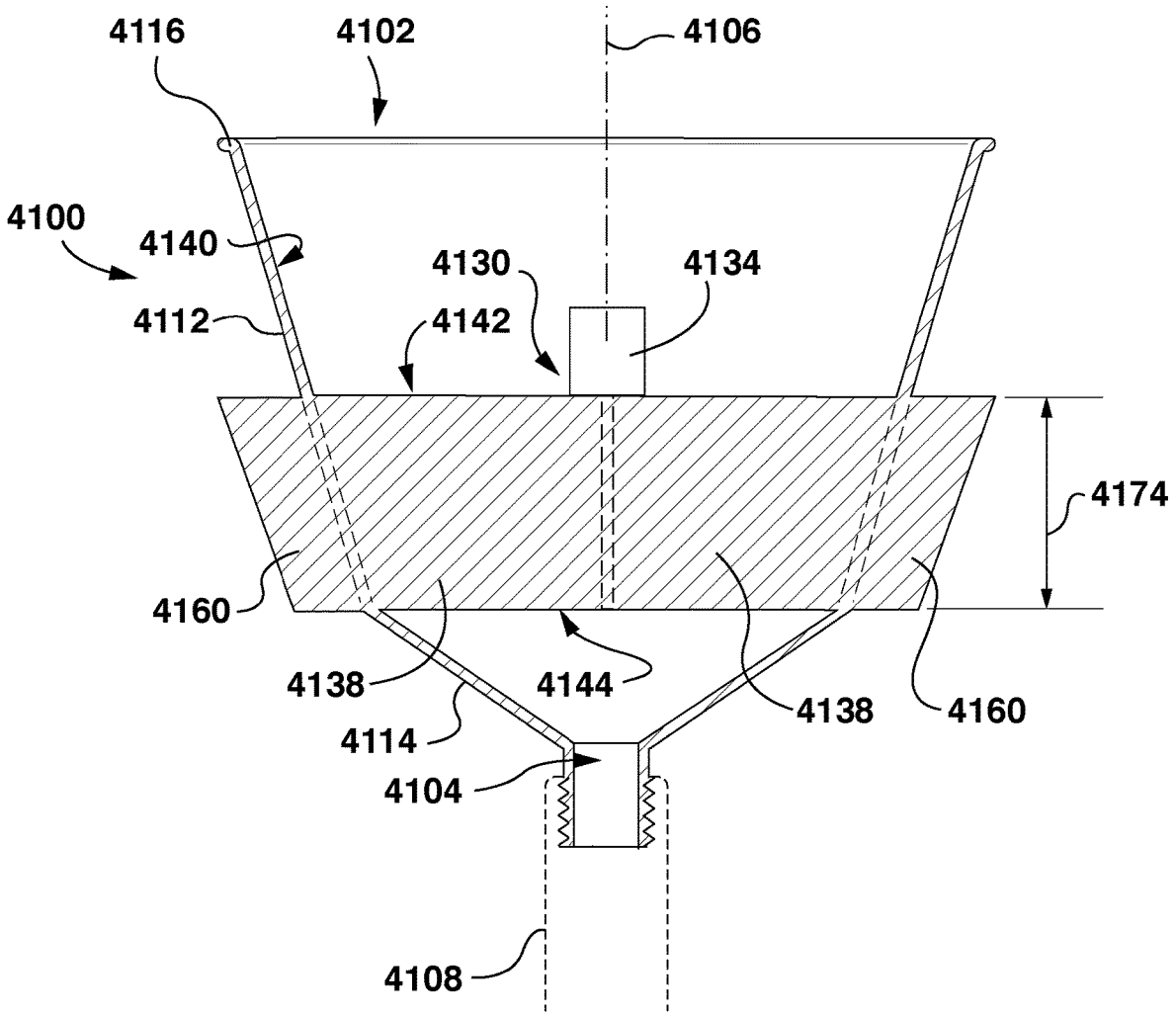
FIG. 9 is a cross-sectional view of another example of a funnel.
Figure 10:
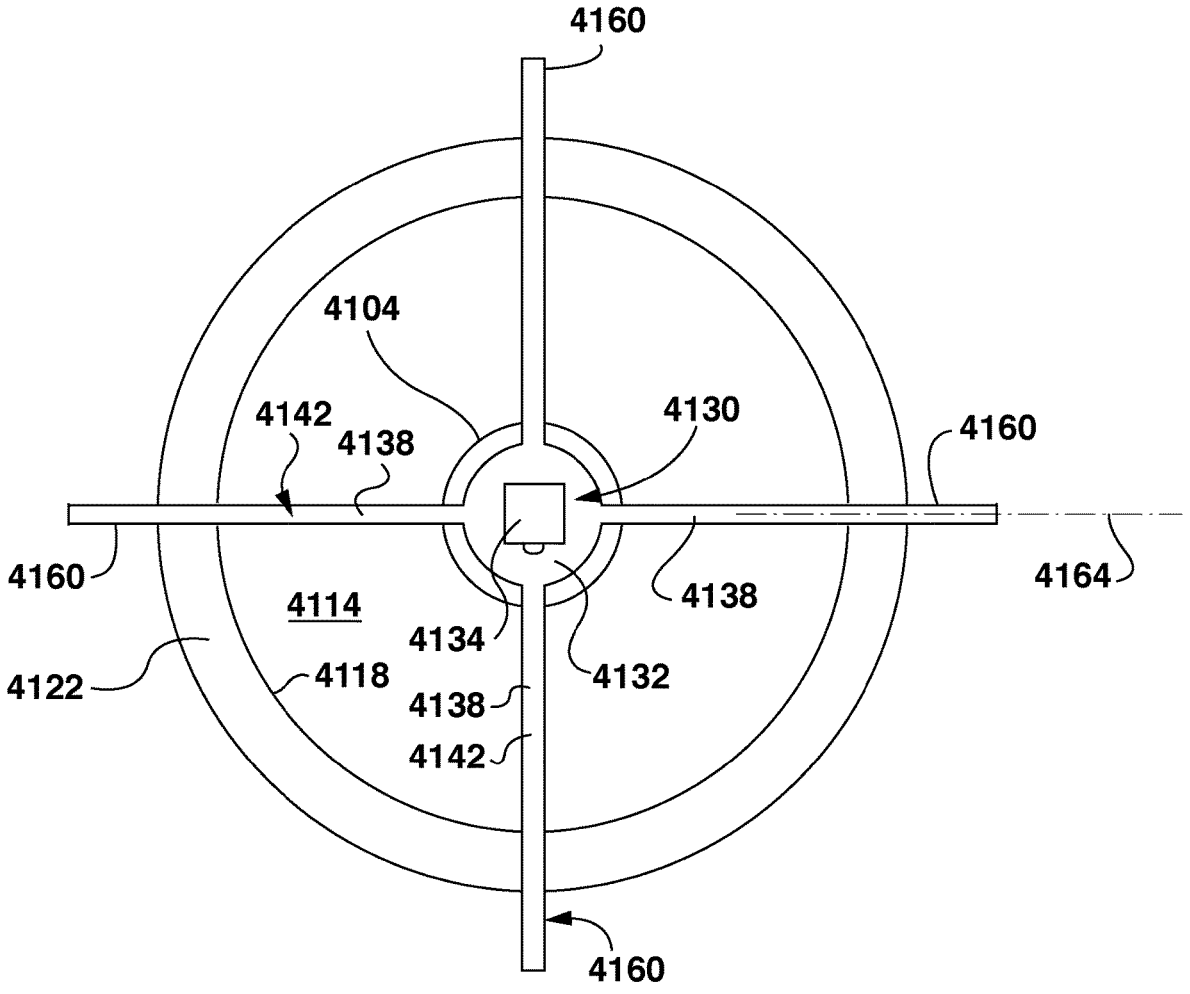
FIG. 10 is a top view of the funnel of FIG. 9.

In this example, the flanges 160 are provided on the lower portion 114 of the funnel sidewall 110. Alternatively, (as shown in FIGS. 9 and 10), the flanges may be provided on the upper portion of the funnel sidewall, or optionally some flanges may be provided on both portions of the funnel sidewall.

Optionally, the tool holder 130 may include a ratchet mechanism, whereby a tool connected to the ratchet mechanism can rotate in one direction relative to the sidewall 110.

In the illustrated example the tool holder 130 is offset from the inlet orifice 102 by an axial offset distance 176. In examples where the tool holder 130 is located within the funnel, the offset distance 176 can be any suitable distance, and may be between about 0% (i.e. flush with the inlet orifice) and about 95% of the axial length of the funnel, and may be between about 10% and about 50% or between about 20% and 40% of the funnel length. In the illustrated example, the offset distance is about 30% of the funnel length.

Referring to FIG. 4, in the illustrated example the inlet orifice 102 has a cross-sectional flow area, i.e. an area taken in an upper plane 178 that is transverse to the funnel axis 106. The outlet orifice 104 has a similar area taken in a lower plane 180 that is parallel to and offset from the upper plane 178. In the illustrated example, the tool holder 130 also defines an area that is transverse to the funnel axis 106. The tool holder area can be any suitable area that is large enough to support a desired tool, but preferably (although not necessarily) is smaller than the inlet orifice area. This can help facilitate the flow of fluid through a flow channel 182 (FIG. 5) that is defined between the perimeter of the tool holder 130 and the inner surface 140 of the sidewall 110. Optionally, the tool holder area can be between about 2% and about 75% of the inlet flow area, and may be between about 5% and about 40% or between about 10% and about 25% of the inlet flow area.

Figure 6:
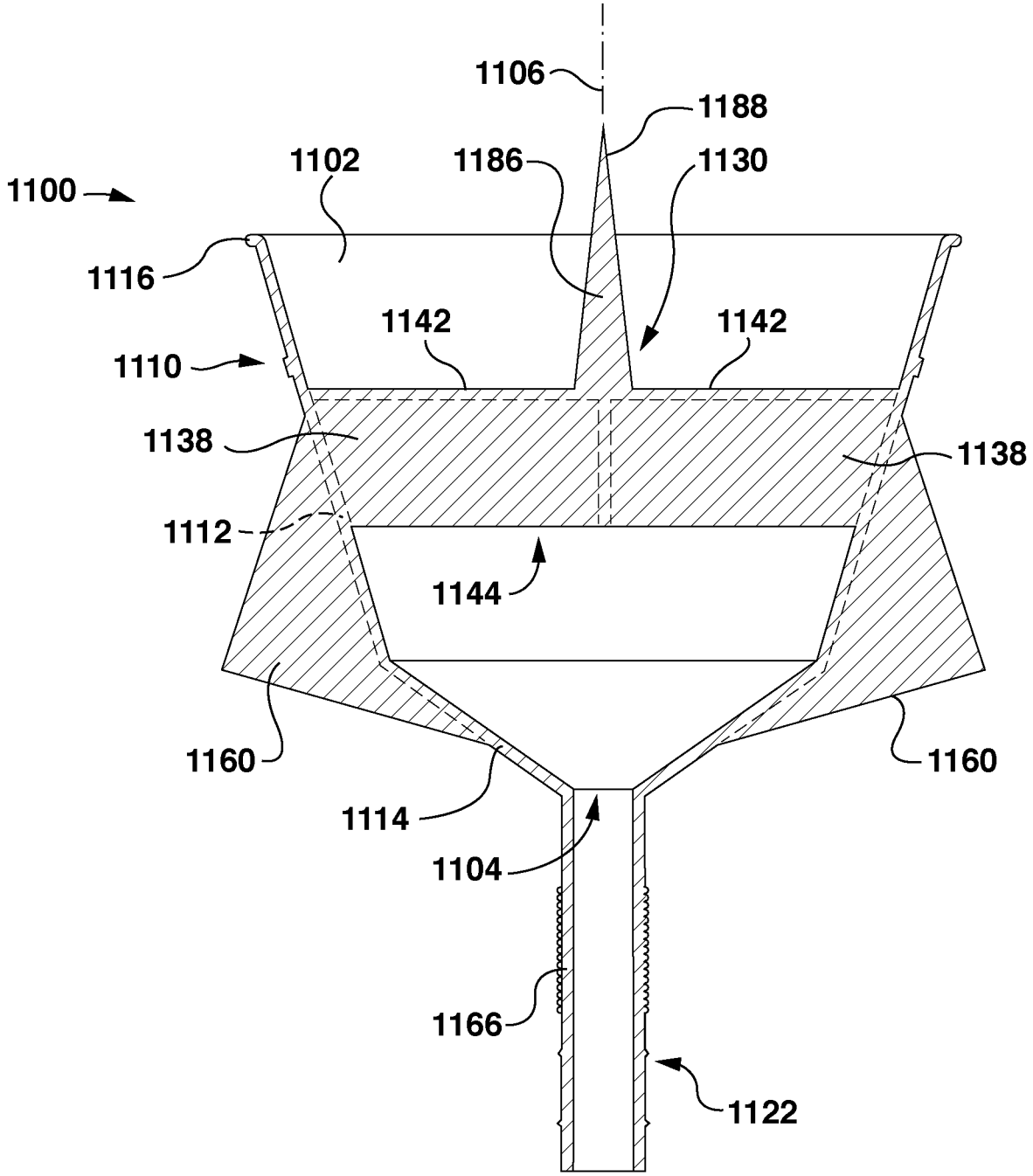
FIG. 6 is a cross-sectional view of another example of a funnel.

Referring to FIG. 6, another example of a funnel 1100 is illustrated. The funnel 1100 is generally similar to the funnel 100, and like features are identified using like reference characters increased by 1000. In this example, the tool holder 2130 includes an integrally molded tool in the form of a spike 1186 that can be used to pierce the sidewall of a container or otherwise form a drain opening. In the illustrated example, a tip 1188 of the spike extends beyond the inlet orifice 1102. This may help a user to align the spike 1186 in a desired location before pressing the spike 1186 into a surface. Alternatively, the spike may be entirely located within the funnel 1100.

In this example, the support members 1138 do not contact the lower portion 1114 of the sidewall. Instead, the support members 1138 are only connected to the upper portion 1112 and effectively suspend the tool holder 1130 within the interior of the funnel 1100, so that the tool holder 1130 overlies the outlet orifice 1104. In this configuration the lower surfaces 1144 of the support members 1130 overlie and face the inner surface of the lower portion 1114 of the sidewall, as well as a portion of the outlet orifice 1104. This may allow liquid to flow under the support members 1138, between the lower surfaces 1144 and the sidewall 1110. In this example, the flanges 1160 extend along a portion of the upper portion 1112 and the lower portion 1114 of the sidewall.

In the embodiment of FIGS. 1-5 the tool holder 130 is disposed within the interior of the funnel 100—i.e. axially between the inlet orifice 102 and the outlet orifice 104. Alternatively, the tool hold can be positioned within the plane of the inlet orifice, surrounded by the rim, or the tool hold may, in some instances, be position axially outboard of the inlet orifice. In such configurations, the inlet orifice may be located axially between the tool holder and the outlet orifice. Positioning the tool holder within or above, but at least partially overlying the inlet orifice may help increase the chances that liquid leaking from a container or object that is engaged by the tool mounted on the tool holder will be caught by the funnel.

Figure 7:
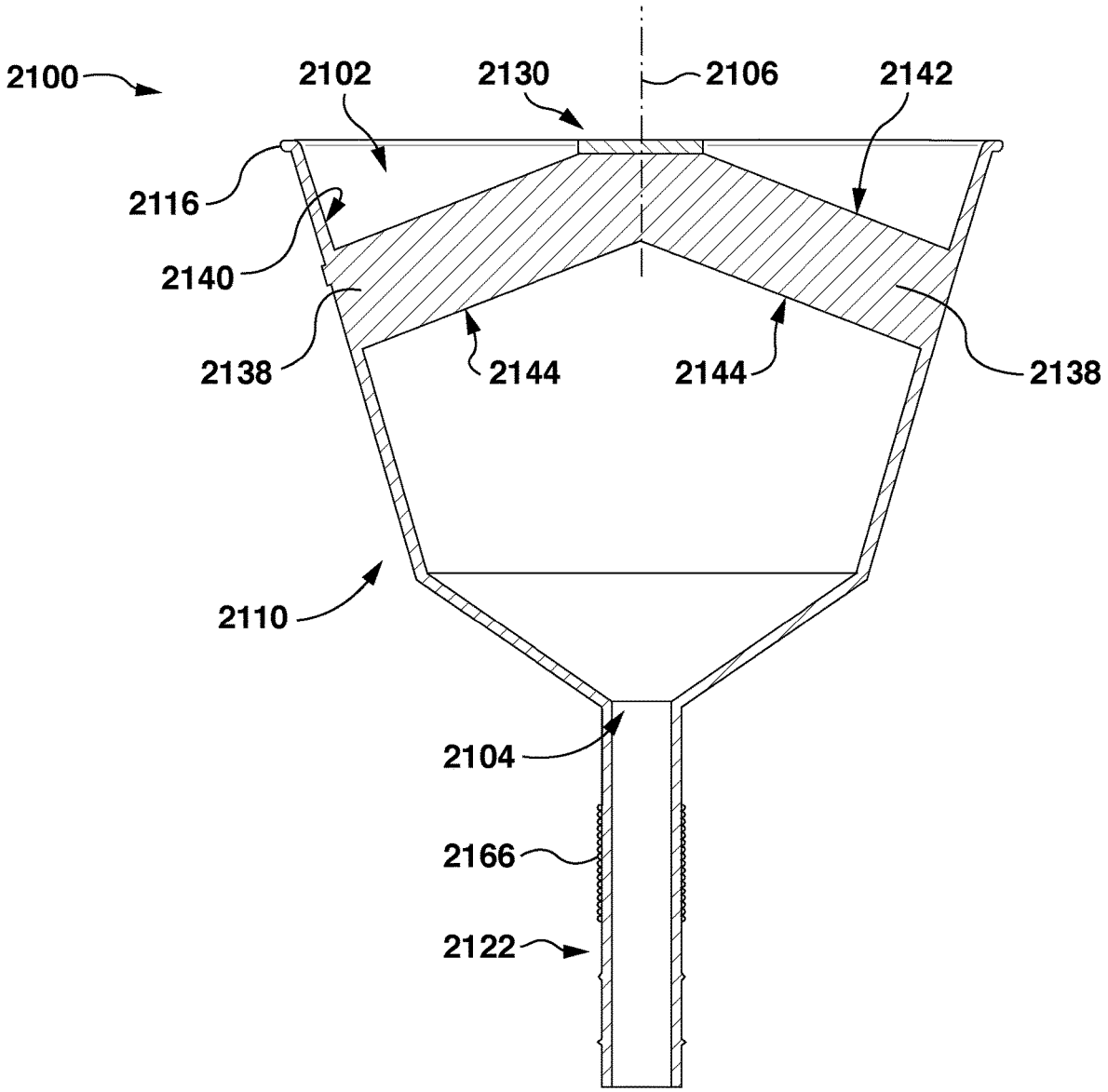
FIG. 7 is a cross-sectional view of another example of a funnel.

Referring to FIG. 7, a funnel 2100 is illustrated. The funnel 2100 is generally similar to the funnel 100, and like features are identified using like reference characters increased by 2000. In this example, the tool holder 2130 is positioned in generally the same plane as the inlet orifice 2102. To help support the tool holder 2130, the support members 2138 extend generally upwardly from the inner surface 2140 of the upper portion 2112 of the sidewall toward the tool holder 2130.

Figure 8:
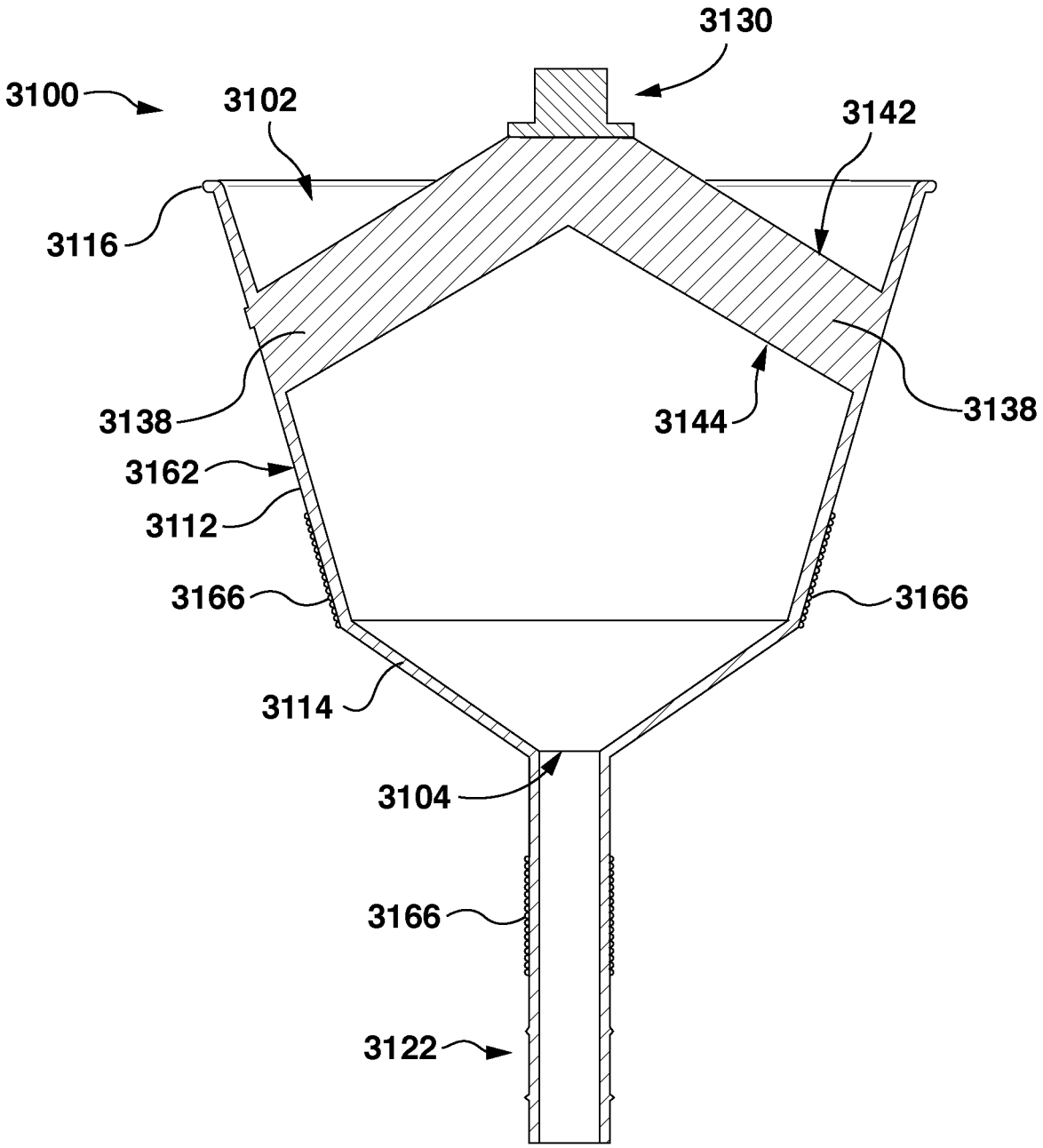
FIG. 8 is a cross-sectional view of another example of a funnel.

Referring to FIG. 8, a funnel 3100 is illustrated. The funnel 3100 is generally similar to the funnel 100, and like features are identified using like reference characters increased by 3000. In this example, the tool holder 3130 is positioned outside the funnel 3110 and is above the inlet orifice 3102. To help support the tool holder 3130, the support members 3138 extend generally upwardly from the inner surface 3140 of the upper portion 3112 of the sidewall toward the tool holder 3130. Also in this example, instead of flanges, the outer surface 3162 of the funnel sidewall 3110 includes grip members in the form of additional regions having a textured surface 3166.

Referring to FIGS. 9 and 10, a funnel 4100 is illustrated. The funnel 4100 is generally similar to the funnel 100, and like features are identified using like reference characters increased by 4000. In this example, the tool holder 4130 is positioned within the funnel 4110 and is supported by four support members 4138. The support members 4138 extend generally radially inwardly from the inner surface 4140 of the upper portion 4112 of the sidewall 4110, toward the tool holder 4130. The upper surfaces 4142 of the support members 4138 face the inlet orifice 4102, and the lower surfaces 4144 face and overlie the second sidewall portion 4114 and the outlet orifice 4104.

In this example, the flanges 4160 extend only from the upper portion 4112 of the sidewall 4110, and are generally axially and radially aligned with corresponding ones of the support members 4138. In this arrangement, the flange length 4174 is generally equal to the support member length along the funnel axis 4106, and the support member axes 4164 intersect corresponding ones of the flanges 4160. In this example, the funnel 4110 does not have a significant neck region, and does not include grips in the form of textured surface portions.

Optionally, the tool holder may be laterally centered relative to the inlet and outlet orifices, and in some examples may be intersected by the funnel axis.

Multiple examples of funnels are described herein. Features from any one example can, to the extent possible, be combined with features from any other ones of the examples to provide a funnel having a particular desired combination of features.

One exemplary method of opening a drain opening in a boundary wall of a container retaining a fluid using the funnel (including any of the funnel described herein) can include the step of positioning the inlet orifice of the funnel adjacent the boundary wall so that the drain opening is located within the funnel. The funnel can then be moved relative to the container to help impart a corresponding movement of the tool supported by the tool holder. This can be done so that the tool engages the container and opens the drain opening allowing fluid to flow out through the drain opening. This may include puncturing or piercing the container to form a drain opening, rotating the funnel to unthread or otherwise remove a plug from the drain opening and the like. Once the drain opening is clear, the method can include catching the fluid flowing out through the opening in the funnel, and optionally conveying the fluid to the outlet orifice while the funnel is being rotated about the funnel axis.

When positioning the funnel, the user may position at least a portion of the plug laterally within the inlet orifice of the funnel and may engage the plug with the tool.

Moving the funnel relative to the container may optionally include rotating the funnel about then funnel axis, thereby causing corresponding rotation of the tool holder and tool about the funnel axis. This can cause corresponding rotation of the plug relative to the boundary wall to unthread the plug.

Piercing a hole in the boundary wall to form the drain opening may include moving the funnel axially toward the boundary wall.

Preferably, at least some of the steps in this method can be performed without a user's hands being positioned axially between the inlet orifice and the boundary wall. This may help reduce the chances of fluid spilling onto the hands of the user, or otherwise missing the funnel.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A funnel comprising:

an inlet orifice;

an outlet orifice axially spaced apart from the inlet orifice along a central funnel axis about which the funnel can be rotated by a user;

a sidewall extending axially between the inlet orifice and the outlet orifice and tapering toward the outlet orifice to guide a liquid entering the inlet orifice toward the outlet orifice, the sidewall comprising an inner surface and an outer surface;

first and second flanges positioned on the outer surface of the sidewall on laterally opposite sides of the funnel for gripping the funnel to impart rotation of the funnel about the funnel axis, each of the first and second flanges being sized to be grasped by the fingers of a user;

a tool holder for holding at least one tool within the funnel axially between the inlet orifice and the outlet orifice, the tool holder comprising a socket mount for interchangeably supporting a plurality of differently sized sockets, and a planar tool support platform upon which the socket mount is supported, the tool support platform being disposed laterally centered relative to the funnel axis and facing the inlet orifice; and a first support member and a second support member spaced apart from the first support member, each of the first and second support members extends between the inner surface of the sidewall and the tool holder to support the tool holder within the funnel, each the first and second support members comprises an upper surface that faces the inlet orifice and an opposing lower surface that is spaced above and overlies the outlet orifice, such that a gap is provided so that liquid can flow beneath the first and second support members and the tool holder and exit the outlet orifice, wherein the sidewall, the first and second flanges, the tool holder, and the first and second support members are of integral, one-piece construction, and wherein the first and second support members and the tool holder are rotatable with the sidewall about the funnel axis to rotatably drive a socket connected to the socket mount when the funnel is rotated about the funnel axis by a user grasping the first and second flanges.

2. The funnel of claim 1, wherein the tool support platform and the upper surface of each of the first and second support members are axially spaced below a rim of the sidewall surrounding the inlet orifice.

3. The funnel of claim 2, wherein the tool support platform and the upper surface of each of the first and second support members are coplanar.

4. The funnel of claim 1, wherein the tool support platform and the upper surface of each of the first and second support members are coplanar.

5. The funnel of claim 1, wherein each of the first and second flanges extends laterally outwardly from the outer surface by a respective flange height that is less than 50 mm.

6. The funnel of claim 1, wherein each of the first and second flanges extends laterally outwardly from the outer surface by a respective flange height that is between 5 mm and 150 mm.

7. The funnel of claim 6, wherein each of the first and second flanges has a length in the axial direction that is between 25 mm and 200 mm.

8. The funnel of claim 1, wherein at least each of the first and second flanges is formed of a low thermal conductivity material to thermally insulate the fingers of the user from liquid in the funnel.

9. The funnel of claim 8, wherein the sidewall, the first and second flanges, the tool holder, and the first and second support members are integrally formed together from plastic.

10. The funnel of claim 1, wherein the sidewall comprises a frusto-conical upper portion that is oriented at a first angle relative to the central funnel axis, and a frusto-conical lower portion that is inclined at a second angle relative to the central funnel axis that is larger than the first angle, the second portion being disposed axially between the first portion and the outlet orifice.

11. The funnel of claim 10, wherein the first and second flanges are disposed on the second portion of the sidewall.

12. The funnel of claim 11, wherein each of the first and second flanges extends laterally outwardly from the outer surface of the second portion by a respective flange height that is less than 50 mm.

13. The funnel of claim 11, wherein each of the first and second flanges extends laterally outwardly from the outer surface of the second portion by a respective flange height that is between 5 mm and 150 mm.

14. The funnel of claim 13, wherein each of the first and second flanges has a length in the axial direction that is between 25 mm and 200 mm.

15. The funnel of claim 10, wherein at least each of the first and second flanges is formed of a low thermal conductivity material to thermally insulate the fingers of the user from liquid in the funnel.

16. The funnel of claim 15, wherein the sidewall, the first and second flanges, the tool holder, and the first and second support members are integrally formed together from plastic.

17. The funnel of claim 10, wherein the tool support platform and the upper surface of each of the first and second support members are axially spaced below a rim of the upper portion of the sidewall surrounding the inlet orifice.

18. The funnel of claim 17, wherein the tool support platform and the upper surface of each of the first and second support members are coplanar.

19. The funnel of claim 10, wherein the tool support platform and the upper surface of each of the first and second support members are coplanar.

20. The funnel of claim 1, wherein the inlet orifice has an inlet flow area that is transverse to the funnel axis, and the tool holder has a holder area that is transverse to the funnel axis and is between about 3% and about 25% of the inlet flow area.

* * * * *